US006419481B2

(12) United States Patent
Ahvenainen

(10) Patent No.: US 6,419,481 B2
(45) Date of Patent: Jul. 16, 2002

(54) COOLER FOR ROTARY KILNS

(75) Inventor: Arto Ahvenainen, Varkaus (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 09/822,737

(22) Filed: Mar. 30, 2001

Related U.S. Application Data

(60) Provisional application No. 60/195,013, filed on Apr. 6, 2000.

(51) Int. Cl.[7] ..... F27B 7/38
(52) U.S. Cl. ..... 432/116; 432/77; 432/79
(58) Field of Search ..... 432/77, 78, 79, 432/103, 115, 116; 34/201

(56) References Cited

U.S. PATENT DOCUMENTS

| | | | | |
|---|---|---|---|---|
| 1,404,381 A | | 1/1922 | Fasting | |
| 2,001,258 A | | 5/1935 | Lindhard | |
| 4,265,301 A | | 5/1981 | Anderson | |
| 4,554,876 A | * | 11/1985 | Grachtrup | 432/115 |
| 5,366,596 A | * | 11/1994 | Taciuk et al. | 432/116 |
| 6,017,213 A | * | 1/2000 | Murata et al. | 432/116 |

FOREIGN PATENT DOCUMENTS

| | | |
|---|---|---|
| DE | 657 149 | 2/1938 |
| FR | 914 760 | 9/1945 |
| WO | WO 94/11690 | 5/1994 |
| ZA | 8900256 | 1/1988 |

* cited by examiner

*Primary Examiner*—Gregory Wilson
(74) *Attorney, Agent, or Firm*—Merchant & Gould PC

(57) ABSTRACT

The present invention relates to a cooler (2) for a rotary drum kiln (1). The cooler comprises two cylindrical housings disposed one inside the other (6, 7), surrounding the kiln and rotating with it, which housings are mounted at the discharge end of the kiln concentrically with the kiln and between which housings an annular space (8) is formed. The housings are attached to each other by means of longitudinal radial partition walls (16), and the inner cylindrical housing (6) is attached at its ends to the kiln. The annular space (8) has a feeding inlet (11) communicating with the kiln for leading the hot material from the kiln into the cooler and a discharge outlet for discharging the cooled material. The material to be cooled flows counter-currently in relation to the cooling gas flow. The annular space (8) comprises at least two parts (12, 13) so that each of the cylindrical housings comprise at least two cylinders (6*a*, 6*b*; 7*a*, 7*b*), in the direction of the longitudinal axis of the kiln sequential, connected to each other. The cylindrical housing (6*b*) comprises means (24) for attaching the cooler to the kiln essentially at the conjunction point (20) of the sequential cylinders (6*a*, 6*b*; 7*a*, 7*b*), too.

9 Claims, 2 Drawing Sheets

COOLER FOR ROTARY KILNS

Figure 1:
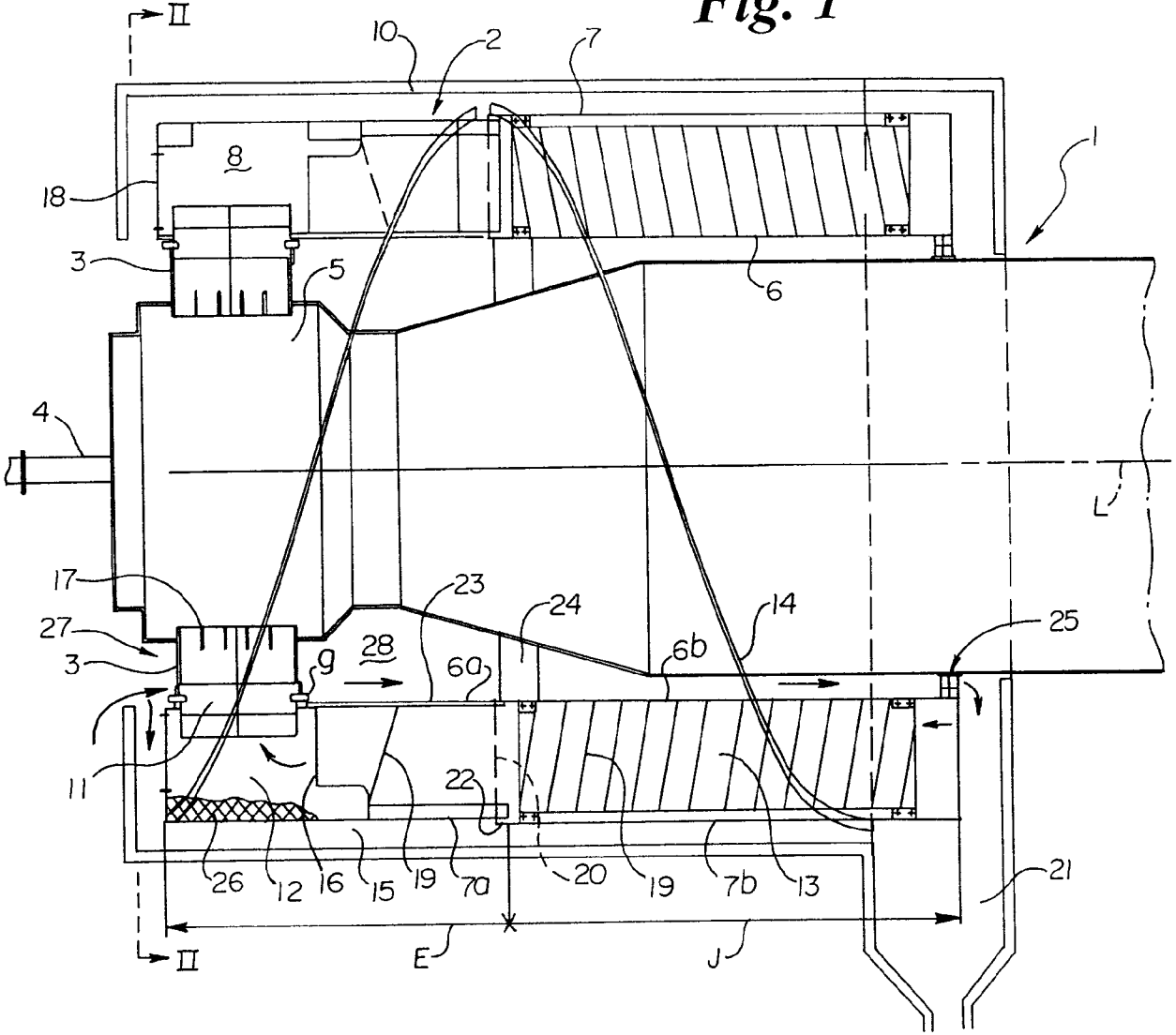

This application claims priority to U.S. Provisional application Ser. No. 60/195,013, filed Apr. 6, 2000 entitled Cooler for Rotary Kilns, the disclosure of which is incorporated by reference herein in its entirely.

The present invention relates to a cooler for cooling material that has been treated in a rotary drum kiln, such as burnt lime, which cooler comprises at least two cylindrical housings positioned one inside the other, surrounding the kiln and rotating with it, which housings have been mounted at the discharge end of the kiln concentrically therewith and between which housings there is formed an annular space, the innermost cylindrical housing being fastened to the kiln at the ends of the housing, and the annular space having a feed inlet in connection with the discharge outlet of the kiln for transferring hot material from the kiln into the cooler and a discharge outlet for discharging cooled material, in which annular space the material flows counter-currently in relation to the cooling gas flow.

The material that has been treated in a rotary drum kiln has typically been cooled in so-called satellite coolers. In this cooling system, a number of cooling cylinders are attached stationary at their inlet ends by means of a drop duct to the kiln shell around the circumference of the kiln. They operate in counter-current principle heating the combustion air going to the kiln. Nowadays the capacity of rotary kilns, such as lime sludge reburning kilns, has risen so high that satellite coolers are no more capable of treating the whole production satisfactorily. The velocity of the air in the drop ducts, the re-entering of material to be cooled back into the kiln, the mass of the coolers, lime dust emission etc. problems are very difficult to control.

It has been possible to essentially decrease the number of this kind of problems by using a so-called sector cooler used in the lime sludge reburning kiln. A sector cooler is a device located outside the shell of a drum kiln and formed of two cylinders disposed one inside the other, which device rotates together with the kiln. It is supported to the kiln shell stationary at its inlet end and by way of motion joint at its discharge end. The object of the cooler is the cooling of hot material passing from the kiln, such as burnt lime generated from lime sludge and the pre-heating of secondary air entering the kiln, respectively. The outer and inner housings of the cooler are joint together by means of elongated plates arranged in the radial direction, whereby the annular space formed between the housings may be divided into the desired number of cooling sectors. At its inlet end the cooler is welded stationary to the kiln shell via drop ducts. Through the drop ducts, hot material is led from the kiln to the inlet end of the cooler. The inlet end is provided with a conical part, receiving the material passing via the drop conduits. The cooler is surrounded by a radiation shield stationary connected to a discharge hopper for cooled material, the objective of which shield is to guide the cooling air in the desired way into the cooler, to prevent dust emission and also to improve the efficiency of the cooler.

The material of the section cooler may be usual low-alloy heatproof ferrite steel, due to which the differences in thermal expansion between the cooler and the kiln shell remain reasonable. Typically, this kind of construction steel is heat-resistant even up to temperatures above 500° C. In a burnt lime cooler, typically more than half of the cooler's length operates in a temperature range where the temperature remains below 550° C.

The cross-section area of the drop ducts may be easily increased, compared to e.g. those of a satellite cooler, by increasing the width of the conduit towards the longitudinal direction of the kiln. This way the velocities of the secondary air may be maintained within admissible limits, whereby even fine particles are easily guided into the cooler. The number of the drop ducts, as well as the sectors, is dependent on the diameter of the kiln. The more sections, the better cooling efficiency is obtained.

The supporting of the section cooler at the discharge end for material to be cooled, e.g. burnt lime, is arranged by means of supporting members fastened to the inner housing of the cooler, which members support the cooler to the kiln shell, allowing for movements caused by temperature differences between the kiln shell and the cooler.

Due to the very high temperature of the material passing from the kiln to the conical part of the cooler, e.g. the temperature of burnt lime is typically between 950 . . . 1050° C., the conical part of the cooler and the first part of the section zone is subjected to a strong thermal stress, which the ferrite steels used in these constructions are not always capable of resisting well enough. Therefore, it is preferable to protect the conical part of the cooler and the first part of the section zone by means of a fireproof inner lining. The resistance of the in-wall may be decreased, though, due to differences between the properties of materials used in the in-wall, on the one hand, and in other parts of the cooler, one the other hand, e.g. thermal expansion coefficients.

The cooler may also be constructed completely of such a material that resists the operating temperatures. This kind of austenitic cooler is well resistant to thermal stress caused by hot material, such as burnt lime. However, attention must be paid to the control of thermal movements between the kiln casing and the cooler made of various materials. In such a case, the cooler must be provided with supporting elements allowing for radial movements, which results in complicated and expensive supporting constructions. Furthermore, a cooler made completely of austenitic material is expensive.

The object of the present invention is to provide a cooler construction mechanically superior to prior art solutions, which construction minimizes the stresses in construction materials caused by both mechanical loads and thermal movements. In addition to that, the cooler is to be economical.

In order to meet these requirements, a characteristic feature of the cooler according to the present invention as stated in the preamble is that the annular space comprises at least two sections so that each cylindrical housing comprises at least two cylinders located sequentially in the direction of the longitudinal axis of the kiln and attached to each other and that the innermost cylindrical housing comprises means for fastening the cooler to the kiln essentially at the junction point of the sequential cylinders, too.

An essential characterizing mechanical feature of the new cooler is that the stationary supporting and fastening points between the cooler and the kiln shell (the supporting and/or fastening point is understood here and after as a plane perpendicular to the longitudinal axis of the kiln, on which plane the individual supporting or fastening points are essentially located both on the kiln shell and in the cooler) are located in the direction of the longitudinal axis of the kiln essentially at the central part of the cooler. In this way, the supporting forces may be distributed to three points instead of the previous two.

Additionally, this makes it possible to divide the cooler in the longitudinal direction into at least two separate parts. Preferably, the annular space forming the cooler has two sections, whereby, in the flow direction of the material to be cooled, the first cylinders disposed one inside the other form the pre-cooler, which receives the hot material passing from the kiln, and the following cylinders disposed one inside the other form the after-cooler, wherefrom the cooled material is discharged. The joining point of the sequential cylinders is located, in the direction of the longitudinal axis, essentially at the central part of the annular space. In connection with this invention, the central part of the cooler, or the annular space, means a zone, which is wider than the mid-point of the length in the direction of the longitudinal axis and its immediate vicinity. The central part covers a zone extending at both sides of the mid-point typically to a length of 40–60% of the total length of the cooler and on which the joining point of the pre- and after-coolers is located. Usually the pre-cooler is shorter than the after-cooler, but depending on process conditions the lengths may be different as well. In a lime sludge reburning kiln, the length of the pre-cooler is typically 30–40% of the total length of the cooler. An essential characteristic of the invention is that by means of a cooler construction according to the invention an additional supporting point is provided in addition to the fastening points at the ends.

Thus, the pre-cooler is a device with cylindrical outer and inner housings and made of suitable heat-resistant material, preferably austenitic material, and located in the inlet part of the cooler. It is supported directly to the ducts for the material passing from the kiln, which are connected to the kiln shell in radial direction, and at the joining point of the pre- and after-coolers to the after-cooler. The inner cylinder of the pre-cooler is fastened to the ducts so that the supporting points act as sliding surfaces, which allows for radial movements caused by differences in the thermal expansion of various materials and temperature differences. The outlet end of the pre-cooler is supported by means of a light slide joint to the inlet end of the after-cooler, which also allows for the necessary radial and axial movements.

The after-cooler is preferably made of normal non-alloy or low-alloy ferrite steel having a thermal expansion coefficient approximately the same as that of the kiln shell. This makes it possible to weld the inlet end of the after-cooler by means of suitable components directly to the kiln shell, whereon an axial fastening point of the central part of the cooler, a so-called mid-support is formed. The pillaring of the discharge end of the after-cooler is effected directly to the surface of the kiln shell by means of slide supports or corresponding members, which allow for radial motion and are not subjected to remarkable bending stresses. As the kiln casing and the after-cooler are preferably made of the same kind of material, differences in their thermal expansion are so small that no special arrangements are needed in view of the radial motion of the after-cooler.

According to one embodiment of the invention, the inlet end of the after-cooler is supported by means of a sliding joint to the outlet end of the pre-cooler. In that case, too, the so-called mid-support of the cooler is attached to the colder part of the cooler (to the after-cooler). The mid-support is always arranged in that part of the cooler, the material of the inner cylinder of which has essentially the same thermal expansion properties as the kiln shell.

The outer and inner housings are fastened to each other by means of radial longitudinal partition walls.

The outer and inner housings of the pre-cooler section of the annular space are cylindrical along the whole of their length, whereby at the inlet end of the pre-cooler there is no feeding cone, but a "feeding cylinder". Due to this, the duct ends, through which the hot material enters the cooler, may extend so deep into the cooler that at the same time the passing of the material through the ducts back into the kiln is prevented.

Figure 2:
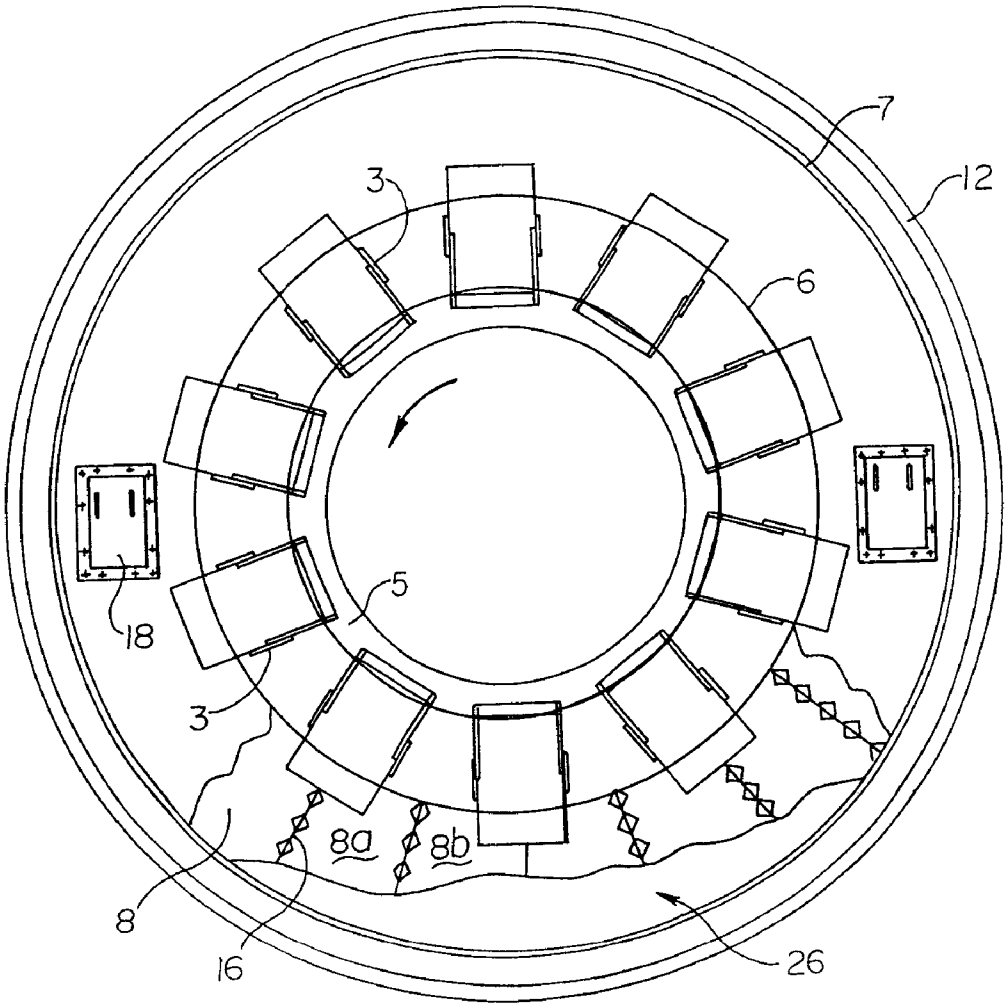

The present invention is described in more detail by means of a cooler embodiment according to the present invention with reference to the appended figures, of which FIG. 1 is a cross-sectional side-view of a cooler according to the invention in connection with a drum kiln, and FIG. 2 is a cross-section according to line II—II of FIG. 1.

FIG. 1 illustrates the discharge end of a rotary drum kiln 1, which discharge end is supported as known per se by means of a supporting ring (not shown) to supporting rolls as the kiln rotates around its longitudinal axis L. Material subjected to thermal treatment, such as lime sludge, is transferred through the kiln as known per se, heated and decomposed in the kiln into burnt lime and carbon dioxide by means of flue gases of the burner 4. After thermal treatment, the material is discharged through the discharge outlet 5 of the kiln communicating with the cooler 2.

The cooler 2 comprises two cylindrical housings 6 and 7 disposed one inside the other, surrounding the kiln 1 and rotating with it, the housings being mounted at the discharge end of the kiln concentrically with the kiln. An annular space 8 is formed between them. The inner cylindrical housing 6 is attached at its first end to the kiln via drop ducts 3. Via the drop ducts, the feed inlet II of the annular space 8 of the cooler communicates with the kiln discharge outlet 5 for leading the hot material from the kiln into the cooler 2. There is a plurality of drop ducts 3 around the circumference of the kiln (FIG. 2). The grizzlies 17 of the drop ducts are located at the inlet end of the ducts. The objective of the grizzlies is to prevent over-sized material particles from entering the cooler 2.

The housings 6 and 7 are attached to each other via radial longitudinal partition walls which divide the annular space into cooling sections 8*a*, 8*b* etc. and in which the material to be cooled flows counter-currently in relation to the cooling air. Inside the cooling sections, there may also be detachable additional cooling components (not shown) which increase the heat transfer surface and the efficiency of the cooler.

In accordance with the invention, in the annular space 8 there are at least two separate sections so that each cylindrical housing 6 and 7 comprises at least two, sequential in the direction of the longitudinal axis L of the kiln, cylinders fastened to each other. The inner housing 6 comprises sequential cylindrical parts, cylinders 6*a* and 6*b*, and the outer housing 7 sequential cylinders 7*a* and 7*b*.

Due to the two-piece construction of the housings, the cooler may be divided in the longitudinal direction into two separate zones. The cooler zone, through which the material first flows, is later called as "pre-cooler" 12 and the zone, wherefrom the material to be cooled is discharged from the kiln and transferred to the process, is later called as after-cooler 13. In FIG. 1, the lengths E and J of the pre-cooler and the after-cooler, respectively, are shown. The pre-cooler, typically made of a more expensive austenitic material, is always as short as possible. The after-cooler is typically made of ferrite steel. In lime sludge reburning kilns, the length E of the pre-cooler is typically 30–40% of the total length of the cooler (E+J).

The pre-cooler 12, consisting of cylinders 6*a* and 7*a*, is located in the first zone of the cooler 2 and receives the hot material passing from the drop ducts 3, which hot material forms a bed 26. The first part of the cylinder 6*a* is supported to the kiln via these drop ducts. The cylinder 6*a* is fastened to the drop ducts 3 via members 9, which preferably may be nested tubular elements. These supporting points also act as sliding surfaces, which allows for radial movements caused by differences in thermal expansion of different materials and temperature differences between various parts of the drop ducts. The outlet end of the pre-cooler is slightly supported at the conjunction point 20 of the pre- and after-coolers by a sliding joint known per se to the inlet end of the after-cooler, which also allows for the necessary radial and axial movements. At the joining point 20, cylinders 6*a* and 7*a* extend into the annular space 13 formed of cylinders 6*b* and 7*b* to a distance long enough in order to form a sliding joint 22 between the pre-cooler and the after-cooler. Thus, the diameter of the cylindrical housing 6*a* is bigger than the diameter of the cylindrical housing 6*b* and, accordingly, the diameter of the cylindrical housing 7*a* is smaller than that of the cylindrical housing 7*b*, so that the pre-cooler 12 is made to extend at the joining point 20 in the desired way into the after-cooler 13.

The diameter dimensions of the pre-cooler and the after-cooler may be the opposite, too, whereby the after-cooler extends into the pre-cooler. To accomplish this, the diameter of the inner cylinder (6*a*) of the pre-cooler (12) is smaller than the diameter of the inner cylinder (6*b*) of the after-cooler and the diameter of the outer cylinder (7*a*) of the pre-cooler is bigger than the diameter of the outer cylinder (7*b*) of the after-cooler 13, so that at the joining point (20) of the sequential cylinders (6*a*, 6*b*; 7*a*, 7*b*), the after-cooler extends into the pre-cooler in order to establish a sliding joint.

Said diameter dimensions may also criss-cross each other, whereby in the inner housing of the annular space, the pre-cooler extends into the after-cooler, while on the outer housing of the annular space, the after-cooler extends into the pre-cooler. The crisscross may be effected in the opposite way, too.

The after-cooler 13 is preferably made of normal non-alloy or low-alloy ferrite steel having a thermal expansion coefficient essentially the same as the kiln shell. This makes it possible to weld the first part of the inner cylinder 6*b* of the after-cooler by means of suitable elements 24 directly to the kiln shell, whereupon a fastening point in the axial direction is formed, too. In order to support the latter part of the after-cooler, the cylinder 6*b* is attached directly to the surface of the kiln shell by means of slide shoes 25 or corresponding members which allow for axial motion and are not subjected to remarkable bending stresses. No special arrangements are needed for supporting the radial motion, as the expansion of the kiln shell does not remarkably differ from that of the cooler.

The new cooler construction is mechanically more durable than previous constructions, as the stationary support 24 and the fastening point between the cooler and the kiln shell are located essentially at the central part of the cooler element. Thus, the supporting forces may be distributed to three points instead of the previous two. Additionally, the supporting of the first and latter ends of the cooler as a whole (points 11 and 25) to the kiln shell has been effected so that radial movements and/or axial movements of the constructions are possible.

At the first part of the pre-cooler 12—at the drop ducts 3—there is no feeding cone, but both the outer casing 7*a* and the inner casing 6*a* are cylindrical along the whole of their length E, whereby at the drop ducts there is a "feeding cylinder". As a result, the ends of the drop ducts 3 may extend into the pre-cooler 12 so deep that at the same time the passing of material through the drop ducts 3 back into the kiln is essentially prevented. In the feeding cylinder zone there are no partition walls 16 connecting the housings 6*a* and 6*b*.

The maintenance of the pre-cooler is easy to effect, as manholes 18 may now be located at the end of the cooler due to the cylindrical construction. The cylindrical construction is also remarkably cheaper to build compared to a cone.

The transportation of the material to be cooled inside the cooler from the material bed 26 is practiced by feeding devices known per se, such as feeding blades 19, which may be located at any wall of the cooler zone. The transportation may also be accomplished by separate members, which are built inside the cooler zone. The cooled material is discharged from the after-cooler 13 into a discharge hopper 21.

The cooler 2 is surrounded by a stationary radiation shield 10, which is encapsulated from the outside and tightly connected to the discharge hopper 21. The objective of the radiation shield 10 is to provide thermal isolation outwards and to prevent dust emission. The end of the radiation shield located furthest from the discharge hopper 21, at the side of the burner 4, is partly open. Through gap 27 between said partly open end and the burner end of the kiln, cooling air is withdrawn into the cooler. Most part of the cooling air is lead via canal 28 between the kiln shell and the inner housing 6 of the cooler through the discharge hopper 21 into the cooler to the section part of it, where the burnt lime is cooled in counter-current principle. Arrows illustrate the flowing of the air. A minor part of the air is directed through the gap between the radiation shield and the cooler to canal 15 between them.

The flowing of the air in canal 28 prevents excess heating of the kiln shell. The heating of the air flow due to the heat caused and transferred by the heater is prevented by means of isolation layer 23 arranged onto the inner housing of the cooler. From the cooler, the pre-heated air flows further through the drop ducts 3 into the kiln 1 as combustion air.

Minor emission of material being cooled may take place in the motion joint 22 of joining point 20 at the central part of the cooler. For this reason, there is a feeding spiral 14 at the outer periphery of the cooler, which spiral feeds the material that has passed into the radiation shield 10 back to the process.

The cooler construction according to the present invention provides many advantages. It is economical, as there is no need to build the whole cooler of expensive heat-resistant material. In addition to that, the manufacturing is quicker. Thermal movements caused by temperature differences are easily controlled. As the cooler is supported to the kiln at more than two separate points, supporting forces needed at one point are smaller. The pre-cooler is an easily replaceable spare part, if needed. Furthermore, the maintenance of the pre-cooler is easy to accomplish through manholes at the end of the cooler.

I claim:

1. A cooler for cooling material that has been treated in a rotary drum kiln, such as burnt lime, said cooler comprising at least two cylindrical housings disposed one inside the other, surrounding the kiln and rotating with it, the housings being mounted at the kiln discharge end concentrically with the kiln, and the innermost cylindrical housing being attached at its ends to the kiln, an annular space between the housings, said annular space having a feed inlet communicating with the discharge outlet of the kiln for leading hot material from the kiln into the cooler and a discharge outlet for discharging cooled material, the material flowing counter-currently in relation to the cooling gas flow, and wherein the annular space comprising at least two zones, so that each of the cylindrical housings comprises at least two cylinders positioned in the direction of the longitudinal axis of the kiln sequentially and connected to each other, and wherein the innermost cylindrical housing comprising means for attaching the cooler to the kiln essentially at the conjunction point of the sequential cylinders.

2. A cooler according to claim 1, wherein said at least two sequential cylinders of each housing are made of different materials.

3. A cooler according to claim 1, wherein the annular space comprises two zones, so that in the direction of flow of the material to be cooled, the first cylinders disposed one inside the other form the pre-cooler zone, which receives the hot material passing from the kiln, and the subsequent cylinders disposed one inside the other form the after-cooler zone, wherefrom the cooled material is discharged.

4. A cooler according to claim 3, wherein the pre-cooler is made of austenitic steel.

5. A cooler according to claim 3, wherein the after-cooler is made of ferrite steel.

6. A cooler according to claim 3, wherein the feed inlet of the annular space, said feed inlet being located in the first inner cylinder of the pre-cooler, communicates with the kiln discharge outlet via ducts attached to the kiln, to which ducts the inner cylinder is attached by members which allow for radial motion between the kiln and the cooler.

7. A cooler according to claim 3, wherein the diameter lengths of the cylinders forming the pre-cooler and the cylinders forming the after-cooler are adapted so that at the conjunction point of sequential cylinders, the pre-cooler and the after-cooler, are appropriately one inside the other for accomplishing a sliding joint at the conjunction point.

8. A cooler according to claim 7, wherein the inner cylinder of the after-cooler is provided with means for attaching the cooler to the kiln casing essentially at the conjunction point of the cylinders.

9. A cooler according to claim 3, wherein the latter end of the inner cylinder of the after-cooler is attached to the kiln by members which allow for radial motion between the kiln and the cooler.

* * * * *